US006338305B1

(12) United States Patent
McHenry et al.

(10) Patent No.: US 6,338,305 B1
(45) Date of Patent: Jan. 15, 2002

(54) ON-LINE REMEDIATION OF HIGH SULFUR COAL AND CONTROL OF COAL-FIRED POWER PLANT FEEDSTOCK

(76) Inventors: H. Thomas McHenry, 1410 Springfield Pike, Apt. 33C, Cincinnati, OH (US) 45215; Alan N. Alpern, 45 E. 58th St., New York, NY (US) 10022

( * ) Notice: Subject to any disclaimer, the term of this patent is extended or adjusted under 35 U.S.C. 154(b) by 0 days.

(21) Appl. No.: 09/550,560

(22) Filed: Apr. 10, 2000

(51) Int. Cl.[7] ..... F23K 1/00; F23K 3/00

(52) U.S. Cl. ..... 110/342; 110/218; 110/232; 110/101 R; 110/101 CF; 110/185

(58) Field of Search ..... 110/218, 232, 110/342, 348, 101 A, 347, 101 C, 185, 101 CF; 44/622

(56) References Cited

U.S. PATENT DOCUMENTS 3,600,676 A * 8/1971 Lugwig et al. ..... 324/61 R
3,823,676 A * 7/1974 Cook et al. ..... 110/1 J
3,926,787 A * 12/1975 Gay ..... 209/3
4,397,248 A * 8/1983 Mehta et al. ..... 110/263
4,466,362 A * 8/1984 Maxwell et al. ..... 110/347
4,473,459 A * 9/1984 Bose et al. ..... 208/8 LE
4,552,077 A * 11/1985 Borio et al. ..... 110/347
4,798,342 A * 1/1989 Williams ..... 241/18
4,817,021 A * 3/1989 Sowerby et al. ..... 364/558
4,964,734 A * 10/1990 Yoshida et al. ..... 374/14
5,022,328 A * 6/1991 Robertson ..... 110/232
5,272,745 A * 12/1993 Smallbone ..... 378/47
5,277,368 A * 1/1994 Kindig ..... 241/20
5,571,490 A * 11/1996 Bronicki et al. ..... 423/244.01
5,655,466 A * 8/1997 Hulkkonen et al. ..... 110/348
5,685,153 A * 11/1997 Dickinson et al. ..... 60/648
5,794,791 A * 8/1998 Kindig ..... 209/727

* cited by examiner

*Primary Examiner*—Henry Bennett
*Assistant Examiner*—K. B. Rinehart
(74) *Attorney, Agent, or Firm*—Milde, Hoffberg & Macklin, LLP

(57) ABSTRACT

The present invention makes possible the economic and environmental use of high sulfur coal by removing the sulfur at the power generating plant. This process reduces the risk of fire, explosion, and freezing in storing and transporting reclaimed, ground coal, and moves the reclamation process to the site of the power plant, while providing electronic controls to monitor and adjust the reclamation process to produce controlled feedstock for the power plant.

9 Claims, 1 Drawing Sheet

ON-LINE REMEDIATION OF HIGH SULFUR COAL AND CONTROL OF COAL-FIRED POWER PLANT FEEDSTOCK

FIELD OF THE INVENTION

The present invention relates to the advantageous use of high sulfur content coal to generate power.

BACKGROUND OF THE INVENTION

The burning of coal to generate power is regulated by the Environmental Protection Agency. Under current regulations coal having a sulfur content of greater than only 1% may not be burned unless the power plant is equipped with a large scrubber to remove $SO_2$ from the exhaust and then the sulfur in the coal must not be more than 1.8%. Coal having no more than 1% sulfur is termed Compliance coal. Naturally occurring coals may have a much higher sulfur content. For instance, Appalachian and Ohio River Basin coal may have a sulfur content as high as 3–5%, occurring in seams of predominantly in the form of iron sulfide particles and its natural directive forms of iron and sulfur. These sulfur compounds are in the form of small nuggets and found in thin layers throughout the coal seams. When strip mining coal with high-sulfur seams, some high sulfur content coal may be mined along with low sulfur content coal. In addition, high-sulfur seams may have to be displaced to get at the low-sulfur coal lying underneath. The mined high sulfur content coal, if saleable, does not command a high price, at a substantial cost to the mine; and if unsaleable must be disposed of according to strict standards.

Many methods have been developed to decrease the sulfur content of coal. Most of these methods involve grinding or crushing the coal to release the small particles or nuggets of sulfur compounds, and, using the difference in density between the coal (density: 1.20–1.35 specific gravity) and the high sulfur compounds, such as iron sulfite (density=5) to separate the two. In the typical method, the small particle size coal and nuggets of sulfur compounds (with water from the crushing and grinding step), are spun in a centrifugal separator or hydrocyclone to "spin down" the reclaimed coal and water while "spinning out" the high sulfur compounds, and other rocks. Given the cost of Compliance coal, these methods are under constant development.

U.S. Pat. No. 3,926,787 describes an improved hydrocyclone with a three-tiered vortex-producing cone to more efficiently "drain" the reclaimed coal at the vortex. The patent makes no mention of electronic controls, or continuous operation with varying sulfur content coal.

U.S. Pat. No. 5,571,490 discloses a chemical treatment for lowering the sulfur content of coal. According to this method, calcium carbonate is mixed with the high sulfur content coal, and reacts with the FeS2 to form CaSO4. In theory, chemical treatments are good, but are difficult to run, as they tend to overload the system, especially the scrubbers. In general, crushing or grinding, and spin separating methods are preferred.

In the past, these crushing and separating processes have been undertaken at the mining site, to produce low-sulfur, saleable, coal. This reclaimed coal was stored, and then transported to a power generating plant. This produced its own set of costs in the form of off-setting risks. To reclaim as much coal as possible, grinding is maximized, decreasing particle size, for better separation, and producing coal "dust" or fines. Dry coal fines are potentially explosive, presenting hazards in storing or transporting the fines. In addition, the water needed in the typical grinding and separating processes increases as the particle size of the ground coal decreases, producing moist coal fines, which are subject to freezing, yielding a non-flowable mass not easily loaded to, or unloaded from transport containers. De-sulfuring the coal at the mine also requires a batch process.

The continuously varying sulfur and moisture content coals arriving at the coal-fired power generating plants require careful monitoring of moisture levels to maintain an efficient burn and to properly desmoke the whole operation. U. S. Pat. No. 3,600,676 describes a method and apparatus for continuously determining the moisture content of bulk goods, such as coal. According to the method two capacitor electrodes or plates are placed adjacent to a flow of bulk goods, and the moisture content calculated as the ratio of contained moisture (from static losses between capacitor plates) to the quantity of the bulk materials (from the dynamic losses between the capacitor plates).

U.S. Pat. No. 5,272,745 describes a method and apparatus for determining the moisture content in a moist material, by measuring the cooling effect at a temperature above the boiling point of the liquid, and at a temperature below the boiling point of the liquid. This method is most appropriate for mixing road surfacing materials, such as cement.

U.S. Pat. No. 4,817,021 discloses a method and apparatus for measuring the water content, density and thickness of a layer of feedstock by measuring the impedance, radio frequency loss or dielectric loss, and back scattered gamma rays. This method, and its implementing apparatus are useful in the present invention. In addition, the patent describes a number of methods (at col., line 51 to col.2, line 5) for the measurement of moisture in coal using capacitance techniques.

U.S. Pat. No. 4,964,734 describes a method for the fast measurement of the moisture content for on-line processing. The method relies on not decomposing the sample with (microwave) heat, hence it requires the pre-measurement of a drying time for the sample material whose moisture is to be measured. Thus it does not lend itself to continuous processes with varying input. The patent also discloses prior art moisture content measuring processes, such a JIS M8811 (Japanese Industrial Standard), infrared moisture meters, electrostatic capacity type moisture meter, a microwave moisture meter, and a neutron moisture meter.

According to the present invention, a more efficient de-sulfuring of coal would take place at the power plant. This would allow combining a continuous de-sulfuring process with a continuous power generation process. With co-ordinated electronic blending controls the overall process can be streamlined to produce the most economical feedstock, and to maximize the economics for using varying sulfur and moisture content coals.

SUMMARY OF THE INVENTION

The present invention comprises both a method and apparatus, which provide a system for the reduction of the sulfur content of coal for either blending with compliance coal at the generating plant or for burning directly without being blended. With the method and apparatus of the present invention, the high sulfur content coal is ground, or crushed, and the sulfur compounds separated from the reclaimed coal, on site at the power generating plant. The result of the separation process is a continuous supply of moist ground coal, with a moisture content permissible for immediate use as feedstock at a power plant. In addition, the method and apparatus use electronic controls to maximize the economics of reducing the sulfur content, and of generating power.

Hence, the present invention is directed to Compliance coal production at the power plant, in a sulfur reduction process that is electronically controlled and continuous, and whose end product is feedstock. By moving de-sulfuring of the coal to the power plant, and providing the coal and coal fines in a continuous supply of feedstock, the costs and the risks of transporting and using the fines is reduced. In addition, the carefully electronically controlled production of feedstock permits calculation of economies of coal use at the time of power generation therefrom.

DETAILED DESCRIPTION OF THE INVENTION

Figure 1:
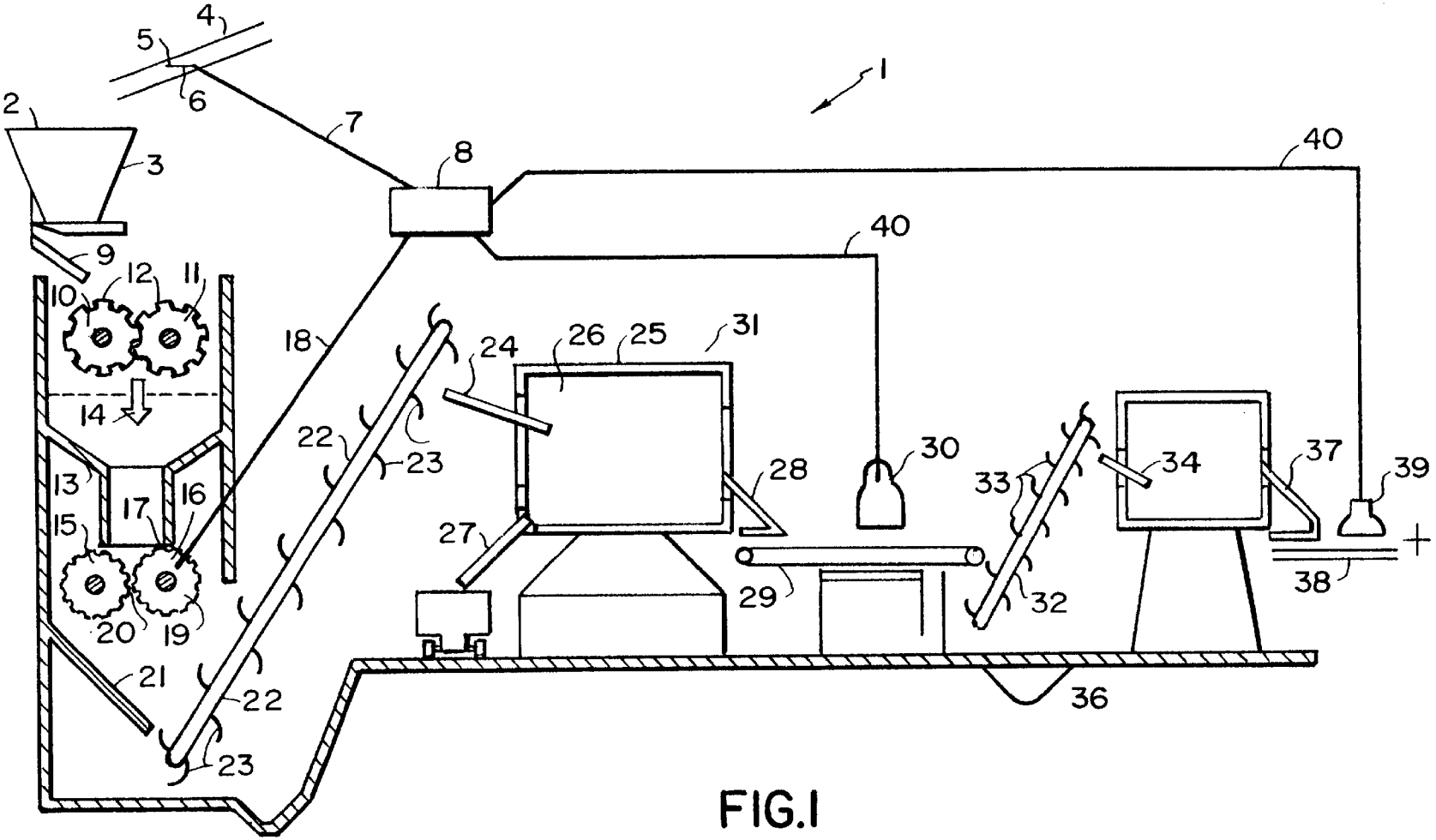
FIG. 1 is a schematic diagram of the apparatus and method of one embodiment of the present invention.

FIG. 1 depicts an apparatus and method for the on-line remediaton of high sulfur content coal, and the control of coal-fired power plant feed stock. The apparatus, shown generally at 1, uses many known pieces of apparatus, and known methods, which were heretofore used at a mining site, to reduce the sulfur level of coal before shipment to a power plant. For example, a water supply is provided to wet the high sulfur content coal before the grinding or crushing process. However, in the present invention, the entire apparatus is placed, and the method takes place, at a power plant; and the processing steps are adjustd to produce, not lower-sulfur content coal for storage and shipment, but a continuous supply of feedstock for a power plant. The method monitors the amount of water added, and the effective cost of the coal, the volume lost in grinding and separating, and the cost of drying, to minimize the costs of power production by utilizing lower cost non-compliance coal.

The apparatus depicted in FIG. 1, operates to de-sulfur a supply of high sulfur content coal, 2, which may be provided in a continuous supply having varying sulfur content. The supply of coal, 2, is fed to a vessel, 3 wherein it is mixed with water from the water source, 4, having means, 5 for controlling the flow, or amount, of water supplied. The means, 5, may comprise an adjustable valve, 6, as shown in FIG. 1. The valve is connected to a means, such as a circuit, 7, and electronic blending control means, 8, for monitoring and adjusting the water flow. The amount of water required is determined by the degree of separation needed or desired. A large reduction in sulfur content requires grinding to a small particle size. The smaller particle sizes hold more water. However, too much water in the ground coal and coal fines results in a loss of heat in steam produced in the firebox, which decreases the amount of heat to create steam in the boiler. The coal mixed with the water is fed, e.g. by chute, 9, to a grinding means, such as the counter rotating pair of crusher rolls, 10 and 11. Rolls 10 and 11 have spiked surfaces, 12. As is known in the art, rolls 10 and 11 accommodate coal of particle size passing a four-inch mesh screen, but mostly retained by a ¼ inch mesh, and reduce particles over 1.25 inches to particles of about ½ inch or less. The ground coal (and water) are then sent by gravity feed through chute, 13 to another pair of counter-rotating crusher rolls, 15 and 16. Crusher rolls 15, and 16, have grooved surfaces, and, as is generally known in the art, are capable of producing uniformly fine particle sizes. Roll 16 has means, 19, for adjusting the gap, 20, between roll 15 and roll 16. Typicaly, such means involve moving roll 16 by moving its axle. As shown in FIG. 1, means 19, are connected by circuit 18, to electronic blending control means 8.

A grinder can be used to produce coal particles which pass through a 50 mesh screen, yielding much greater reductions in sulfur content. It should be noted that the power plant process converts the sulfur compounds into sulfur dioxide fumes, which, in moist air, creates acid rain. A grinder (not shown in FIG. 1) may be used alone or following the crusher rolls to produce smaller particle sizes. This will increase the amount of water used and retained through the grinding/crushing process. If only a little sulfur needs to be removed, the crusher rolls shown in FIG. 1 may be operated so as to not to produce coal fines, and to require only a mist of water admixed with the coal supply, 2, prior to crushing.

From the grinding operation, illustrated here as a twin set of crusher rolls, the ground coal and water are directed by chute, 21, to a belt lifting conveyor, 22, with scoop-like appendages, 23, to hold both the coal and the water, transferring them to the feed means, such as chute, 24, to a centrifugal separator, 25. T he separator, 25, operates in the manner of many known centrifugal separators. The high density particles; FeS2, rock, etc. will be forced to the outer wall. A horizontally disposed spiral scrapper, 26, scrapes both toward the left and to the right in FIG. 1, scrapping the denser material, (the iron sulfur compounds and rocks) off the outer wall of the separator to the high sulfur residue dump, 27. This material may be reclaimed and used to produce sulfur compounds such as sulfuric acid. If a grinder is used to create very small particle sizes, a hydrocyclone, or any other type of separator, may be preferred to a centrifugal separator.

The reclaimed coal, and water, exit the separator at 28, and are directed to a conveyor belt, 29. This reclaimed coal may contain more "fines" than would be safe in a coal reclaiming process at a mine, as the fines are not inended for shipment or storage, but will be immediately used as feedstock. The reclaimed coal is then analyzed for sulfur content by means, such as x-ray spectrometer, 30, or x-ray florescence, or x-ray defraction techniques. When using x-ray florescence, the level of sulfur may be determined indirectly by measuring the high molecular weight of iron in the iron sulfites. Means, 30, is connected to electronic blending means 8, by circuit, 31, for continuous monitoring the sulfur level, and the percentage volume lost in this sulfur reduction process. Based on the actual suphur levels, the electronic blending control means 8 can adjust the water flow and the crusher roll gap to adjust particle size and permit more or less residual sulfur in the reclaimed coal emerging from the separator. Though FIG. 1 illustrates a centrifugal separator, other alternative means for separating may be used, such as a number of smaller cyclone separators.

From conveyor belt 29, the reclaimed coal (and water) are directed to a conveying means 32, preferrably with scoop-like appendages, 33, to transport the reclaimed coal to the drier feed means, such as chute 34, of a centrifugal drier, 35. Most of the flowable water phase traveling with the reclaimed coal is eliminated before entry into the drier, such as by draining through an apertured conveyor belt, 29, or apertured conveying means, 32. The water may be directed to drain, 36, and, if desired, may be recyled and reused in the system. Any water extracted through the drying process may also be drained at 36, and added to the water to be recycled. The drier output, at 37, is directed to means, such as conveyor, 38, for receiving the feedstock.

The reclaimed coal is analyzed by known means, such as those described in U.S. Pat. No. 4,817,021, for continuously determining the moisture content of the reclaimed coal to keep it within the acceptable parameters for feedstock. For example, using an ac signal generator connected across two electrodes remote from the reclaimed coal, but generating an ac field passing through the reclaimed coal, and measuring means to detect the ac impedance, radio frequency loss or dielectric loss, for deriving the moisture content of the reclaimed coal. Means, 39, is connected, as by circuit, 40, to the electronic blending control means, 8, which adjusts the water flow, gap, volume percentage lost in reducing the sulfur, and other costs, with the current inventory replacement costs of high sulfur content coal and Compliance coal, to achieve the greatest possible economies in power production.

The reclaimed coal leaves the drier, and is conveyed to the power plant's existing crushers where it is reduced to a fine powder that is blown into the firebox. The reclaimed coal is combined with low sulfur coal from the plant's Compliance coal stockpile. The precise blend can be determined by sulfur and moisture content of the mix and economic factors.

The present invention is not to be considered limited in scope by the specific embodiments described above, as these embodiments are intended only to be illustrative of particular aspects of the invention. Modifications of the above-described embodiments and modes for carrying out the invention that are obvious to those skilled in the coal fired generation of power, or power generators, or coal mining and refining, are intended to be within the scope of the following claims.

We claim:

1. A method for blending high sulfur content coal and compliance coal to maximize the economics of generating power therefrom, the method comprising the steps of:

1) wetting the high sulfur content coal with water, 2) grinding the high sulfur content coal to produce dense high-sulfur compounds and rock, and less dense ground coal and coal fines, 3) using a separator to separate out the dense rock and high-sulfur compounds from the less dense ground coal and coal fines and water, 4) eliminating any flowable water yielding moist ground coal, 5) determining the sulfur content of the moist ground coal and coal fines, 6) reducing the moisture content of the ground coal and coal fines, and 7) monitoring the moisture content of the ground coal and coal fines, wherein the amount of water introduced in the wetting step, 1, is electronically controlled, the volume of the dense rock and sulfur compounds separated out in step 3 is electronically controlled, the sulfur content determined in step 5 is monitored by the electronic controls, and the moisture content of the coal fines determined in step 7 is monitored by the electronic controls, to produce the most economic, legally acceptable, continuous supply of feedstock coal for a power plant.

2. The method of claim 1, further comprising the step of adjusting the grinding process of step 2 by means of the electronic controls.

3. The method of claim 1, wherein the high sulfur content coal is ground in a two step process, the second step of which is size controlled by the electronic controls.

4. The method of claim 3, wherein the high sulfur content coal is ground between twin sets of roll crushers, each of the first set of roll crushers having spiked surfaces, and each of the second set of roll crushers having grooved surfaces, and the gap between the second set of rollers being adjustable by the electronic controls to control the size range of the ground coal fines.

5. The method of claim 1, wherein the sulfur content of the coal fines is determined using x-ray spectroscopy, x-ray florescence, or x-ray defraction techniques.

6. The method of claim 1, wherein the moisture content determination in step 7 is accomplished using a gamma ray field passing through the reclaimed coal.

7. The method of claim 6, wherein determination of the moisture content further comprises a gamma ray back scattering source and detector for determining the moisture content of the reclaimed coal.

8. A method for continuously removing sulfur compounds from a continuous supply of high sulfur content coal, prepare for immediate use as feedstock at a power generating plant, said method comprising:

a) admixing water with a continuous supply of high sulfur content coal, and feeding the resulting mixture to an electronically controlled-for-size grinder, b) grinding and separating the high sulfur content coal into dense suphur compunds and rocks, and less dense coal fines, c) separating the dense sulfur compounds and rocks from the less dense ground coal, d) continuously measuring the sulfur content of the ground coal and coal fines, and transmitting the measurements to the electronic controls of the apparatus e) reducing the moisture content of the ground coal and coal fines, and f) continuously measuring the moisture content of the ground coal and coal fines, and transmitting the measurements to the electronic controls of the apparatus to adjust the water admixed, the particle size of the ground coal, and the moisture content of the dried reclaimed coal and fines.

9. An apparatus with electronic controls for continuously removing sulfur compounds from a continuous supply of high sulfur content coal, prepared for immediate use as feedstock at a power generating plant, said apparatus comprising:

a) means for mixing a determined amount of water with a continuous supply of high sulfur content coal, and feeding the resulting mixture to b) an electronically controlled-for-size grinder, which grinds the high sulfur content coal into dense high sulfur compounds and rocks, and moist ground coal and coal fines, and means for transferring the ground material to c) a separator, separating the dense high sulfur content coal and rocks from the moist ground coal and coal fines, d) means for continuously measuring the sulfur content of the ground coal and coal fines, and transmitting the measurements to the electronic controls of the apparatus e) means for reducing the moisture content of the ground coal and coal fines where required for economic distribution, and f) means for continuously measuring the moisture content of the ground coal and coal fines, and transmitting the measurements to the electronic controls of the apparatus.

* * * * *